US007306173B2

(12) United States Patent
Pilgram et al.

(10) Patent No.: US 7,306,173 B2
(45) Date of Patent: Dec. 11, 2007

(54) FUEL INJECTION VALVE

(75) Inventors: Guido Pilgram, Schwieberdingen (DE); Joerg Heyse, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 18 days.

(21) Appl. No.: 10/297,556

(22) PCT Filed: Mar. 16, 2002

(86) PCT No.: PCT/DE02/00965

§ 371 (c)(1),
(2), (4) Date: Jun. 17, 2003

(87) PCT Pub. No.: WO02/084104

PCT Pub. Date: Oct. 24, 2002

(65) Prior Publication Data

US 2004/0021014 A1 Feb. 5, 2004

(30) Foreign Application Priority Data

Apr. 11, 2001 (DE) ..... 101 18 163

(51) Int. Cl.
*B05B 1/30* (2006.01)

(52) U.S. Cl. ..... 239/585.5; 239/900; 239/288; 239/533.12

(58) Field of Classification Search ..... 239/533.2, 239/533.3, 533.4, 533.5, 533.6, 533.7, 533.9, 239/533.11, 533.12, 585.1–585.5, 900, 288
See application file for complete search history.

(56) References Cited

U.S. PATENT DOCUMENTS 4,519,370 A 5/1985 Iwata
4,650,122 A * 3/1987 Kienzle et al. ..... 239/497
4,662,567 A * 5/1987 Knapp ..... 239/585.4
4,890,794 A * 1/1990 Imafuku et al. ..... 239/533.12
4,934,605 A * 6/1990 Hans et al. ..... 239/585.4
5,163,621 A * 11/1992 Kato et al. ..... 239/533.12
5,340,032 A * 8/1994 Stegmaier et al. ..... 239/585.1
5,348,232 A * 9/1994 Babitzka et al. ..... 239/585.4
5,423,489 A * 6/1995 Wood ..... 239/575
5,586,726 A 12/1996 Furuya et al.
5,707,012 A * 1/1998 Maier et al. ..... 239/585.4
5,752,316 A * 5/1998 Takagi et al. ..... 29/888.4
5,881,957 A 3/1999 Mizuno et al.
5,979,866 A * 11/1999 Baxter et al. ..... 239/585.1
6,131,826 A 10/2000 Teiwes
6,186,419 B1 * 2/2001 Kampmann et al. ... 239/533.12
6,220,528 B1 * 4/2001 Cooke et al. ..... 239/533.3

FOREIGN PATENT DOCUMENTS

DE 33 21 286 12/1983

(Continued)

*Primary Examiner*—Christopher S. Kim
(74) *Attorney, Agent, or Firm*—Kenyon & Kenyon LLP

(57) ABSTRACT

A fuel injector for fuel-injection systems of internal combustion engines has a solenoid coil; a valve needle that is operatively connected to the solenoid coil and acted upon by a restoring spring in a closing direction, in order to actuate a valve-closure member which, together with a valve-seat surface formed at a valve-seat member, forms a sealing seat; and at least two spray-discharge orifices which are formed in the valve-seat member. The spray-discharge orifices are formed in the valve-seat member in such a way that they are shielded from mixture flows circulating in a combustion chamber of the internal combustion engine.

2 Claims, 2 Drawing Sheets

FOREIGN PATENT DOCUMENTS

| | | | |
|---|---|---|---|
| DE | 37 04 543 | | 8/1988 |
| DE | 195 30 995 | | 2/1997 |
| DE | 197 26 727 | | 1/1999 |
| DE | 198 02 883 | | 8/1999 |
| DE | 198 04 463 | | 8/1999 |
| DE | 199 37 961 | | 2/2001 |
| DE | 100 38 098 | A1 * | 2/2002 |
| EP | 0 348 786 | | 1/1990 |
| FR | 2 528 915 | | 12/1983 |
| GB | 2033044 | A * | 5/1980 |
| GB | 736 264 | | 10/1995 |

* cited by examiner

FUEL INJECTION VALVE

BACKGROUND INFORMATION

German Patent Application No. 198 04 463 describes a fuel-injection system for a mixture-compressing internal combustion engine having external ignition, which includes a fuel injector injecting fuel into a combustion chamber formed by a piston/cylinder construction, and which includes a spark plug projecting into the combustion chamber. The fuel injector is provided with at least one row of injection orifices distributed over the circumference of the fuel injector. By a selective injection of fuel via the injection orifices, a jet-controlled combustion method is implemented by a mixture cloud being formed using at least one jet.

What is disadvantageous about the fuel injector known from the aforementioned printed publication, in particular, is the deposit formation in the spray-discharge orifices. These deposits clog the orifices and cause an unacceptable reduction in the flow rate through the injector. This leads to malfunctions of the internal combustion engine.

SUMMARY OF THE INVENTION

The fuel injector according to the present invention has the advantage over the related art that the spray-discharge orifices are implemented in such a way that the mixture flows circulating in the combustion chamber are shielded from the spray-discharge orifices of the multiple-hole fuel injector, so that no fuel is able to settle in the region of the spray-discharge orifices.

The spray-discharge orifices are advantageously configured within a round or oval, complete or partial circular wall, which is high enough to shield each spray-discharge orifice from the flows circulating in the combustion chamber.

It is advantageous to produce the circular wall, together with the valve-seat member, from one workpiece by burning on a lathe or machine-cutting. Alternatively, subsequently to the manufacture of the valve-seat member, the circular wall may also be mounted on its end face.

Moreover, the shielding may also be achieved by using at least one annular groove into which the spray-discharge orifices discharge. In this way, the outer edge of the annular groove is able to shield the recessed spray-discharge orifices.

Advantageous in this context is the formation of a single annular groove, which encloses a concave section of the end face of the valve-seat member, in which the spray-discharge orifices may be positioned in any desired configuration, the outer edge of the single annular groove shielding them in their entirety from the mixture flows.

DETAILED DESCRIPTION

Figure 1:
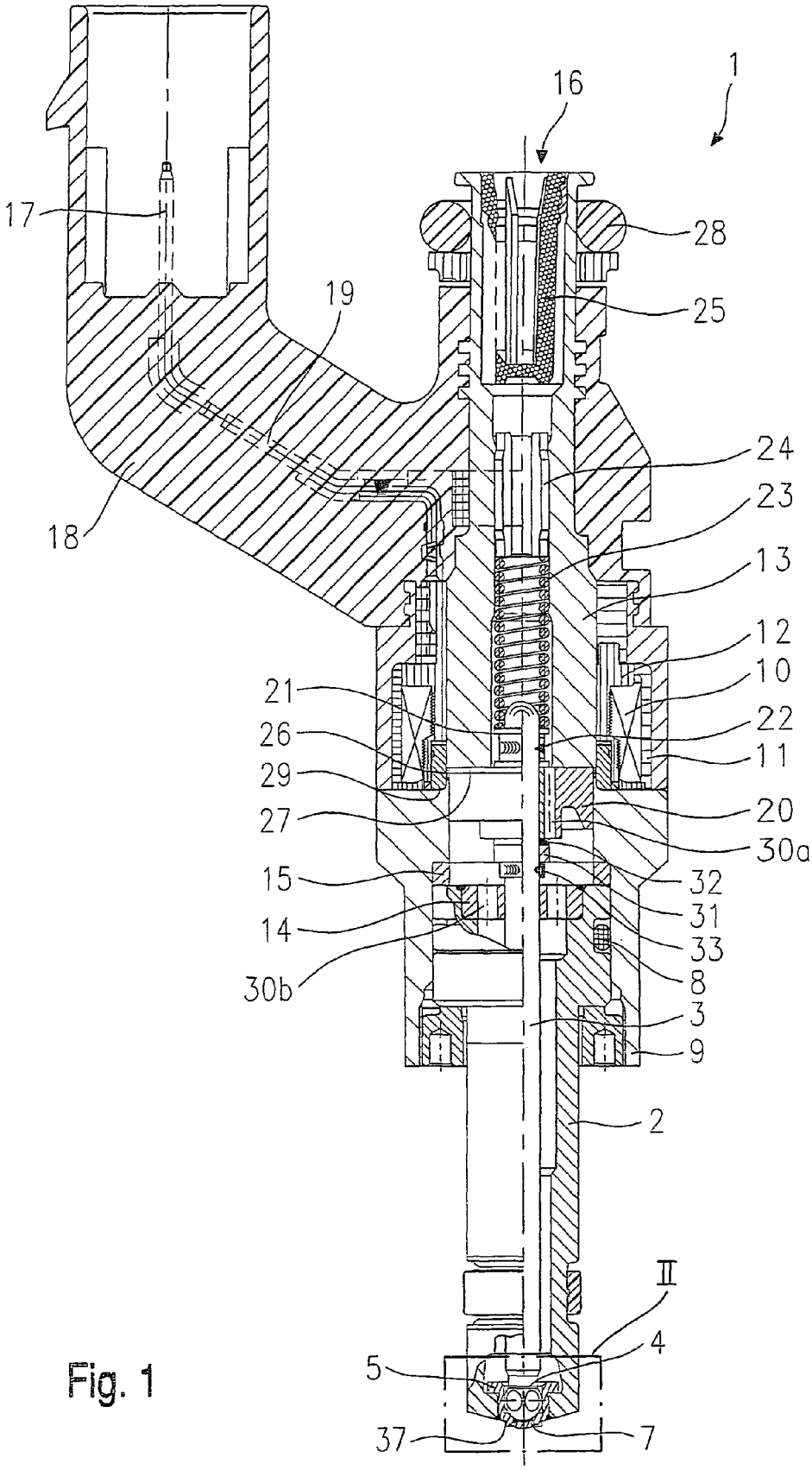
FIG. 1 shows a schematic section through a first exemplary embodiment of a fuel injector according to the present invention.

FIG. 1 shows a part-sectional view of a first exemplary embodiment of a fuel injector 1 according to the present invention. Fuel injector 1 is in the form of a fuel injector 1 for fuel-injection systems of mixture-compressing internal combustion engines having external ignition. Fuel injector 1 is suited for directly injecting fuel into a combustion chamber (not shown) of an internal combustion engine.

Fuel injector 1 is made up of a nozzle body 2 in which a valve needle 3 is positioned. Valve needle 3 is in operative connection with a valve-closure member 4, which cooperates with a valve-seat surface 6, situated on a valve-seat member 5, to form a sealing seat. In the exemplary embodiment, fuel injector 1 is an inwardly opening fuel injector 1, which has two spray-discharge orifices 7.

Valve-closure member 4 of fuel injector 1, designed according to the present invention, has a nearly spherical shape. In this way, a displacement-free, cardanic valve-needle guidance is achieved, which provides for a precise functioning of fuel injector 1.

Valve-seat member 5 of fuel injector 1 has a nearly cup-shaped design and, by its form, contributes to the valve-needle guidance. Valve-seat member 5 is inserted into a discharge-side recess 34 of nozzle body 2 and connected to nozzle body 2 by a welding seam 35.

A seal 8 seals nozzle body 2 from an outer pole 9 of a solenoid coil 10. Solenoid coil 10 is encapsulated in a coil housing 11 and wound on a coil brace 12, which rests against an inner pole 13 at solenoid coil 10. Inner pole 13 and outer pole 9 are separated from one another by a gap 26 and are braced against a connecting member 29. Solenoid coil 10 is energized via an electric line 19 by an electric current, which may be supplied via an electrical plug contact 17. Plug contact 17 is enclosed by a plastic coating 18, which may be extruded onto inner pole 13.

Valve needle 3 is guided in a valve-needle guide 14, which is disk-shaped. A paired adjustment disk 15 adjusts the lift. On the other side of adjustment disk 15 is an armature 20. Armature 20, via a first flange 21, is in force-locking connection with valve needle 3, which is connected to first flange 21 via a welding seam 22. Braced against first flange 21 is a return spring 23 which, in the present design of fuel injector 1, is prestressed by a sleeve 24.

On the discharge-side of armature 20 is a second flange 31 which is used as lower armature stop. It is connected to valve needle 3 via a welding seam 33 in a force-locking fit. An elastic intermediate ring 32 is positioned between armature 20 and second flange 31 to damp armature bounce during closing of fuel injector 1.

Fuel channels 30*a* through 30*c* run through valve needle guide 14, armature 20 and valve seat member 5, which conduct the fuel, supplied via central fuel supply 16 and filtered by a filter element 25, to spray-discharge orifice 7. A seal 28 seals fuel injector 1 from a distributor line (not shown further).

According to the present invention, at an end face 36 of valve-seat member 5 facing the combustion chamber (not shown further), fuel injector 1 is provided with a circular wall 37, which at least partially surrounds the two spray-discharge orifices of the present exemplary embodiment. Valve-seat member 5 is located in a recess 34 of nozzle body 2 and connected to it by, for instance, a welding seam 35. The shielding of spray-discharge orifices 7 by circular wall 37 from mixture flows circulating in the combustion chamber prevents a deposit from forming on spray-discharge orifices 7. The discharge-side part of fuel injector 1, which includes circular wall 37, is shown in greater detail in FIG. 2.

In the rest state of fuel injector 1, return spring 23 acts upon first flange 21 at valve needle 3, oppositely to its lift direction, in such a way that valve-closure member 4 is retained in sealing contact against valve seat 6. Armature 20 rests on intermediate ring 32, which is supported on second flange 31. When solenoid coil 10 is energized, it builds up a magnetic field which moves armature 20 in the lift direction against the spring tension of return spring 23. Armature 20 carries along first flange 21, which is welded to valve needle 3, and thus valve needle 3 in the lift direction as well. Valve closure member 4, being operatively connected to valve needle 3, lifts off from valve seat surface 6, and the fuel guided via fuel channels 30*a* through 30*c* to spray-discharge orifice 7 is sprayed off.

When the coil current is turned off, once the magnetic field has sufficiently decayed, armature 20 falls away from inner pole 13, due to the pressure of restoring spring 23 on first flange 21, whereupon valve needle 3 moves in a direction counter to the lift. As a result, valve closure member 4 comes to rest on valve-seat surface 6, and fuel injector 1 is closed. Armature 20 comes to rest against the armature stop formed by second flange 31.

Figure 2:
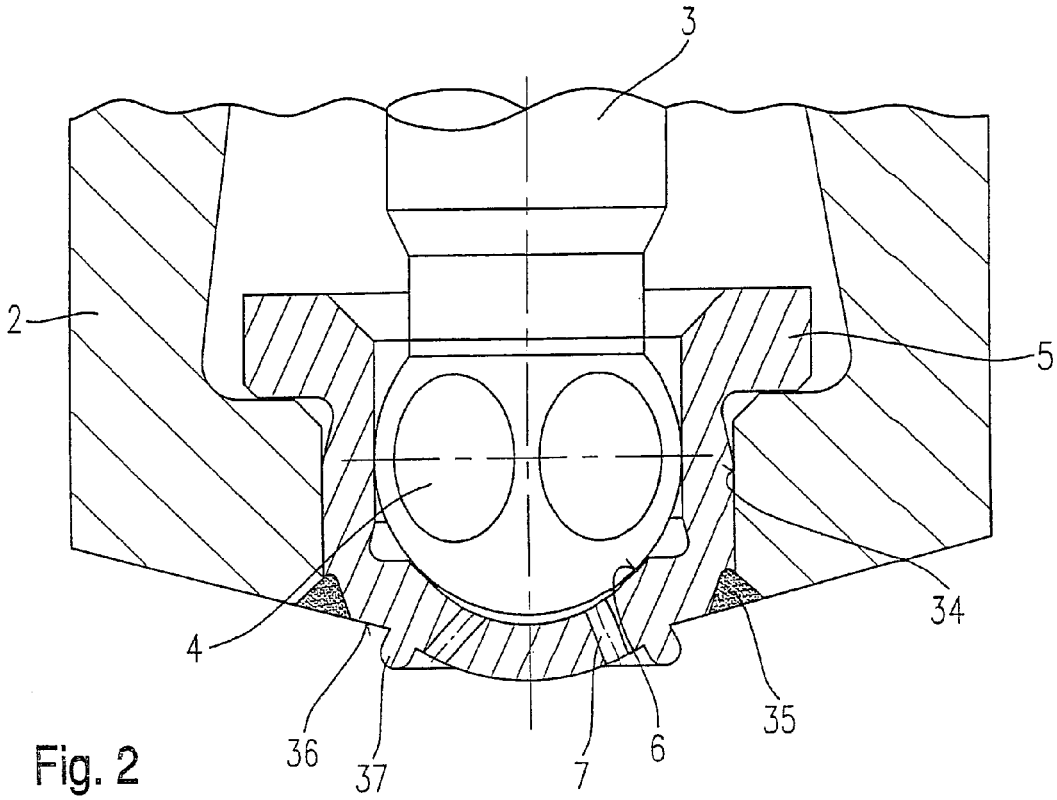
FIG. 2 shows a schematic section through the discharge-end section of the first exemplary embodiment of the fuel injector according to the present invention represented in FIG. 1, in region 11 in FIG. 1.

In a part-sectional view, FIG. 2 shows the cut-away portion, designated 11 in FIG. 1, from the first exemplary embodiment of a fuel injector 1 according to the present invention represented in FIG. 1.

As already mentioned briefly in FIG. 1, at its end face 36 facing the combustion chamber, valve-seat member 5 is provided with a circular wall 37, which at least partially surrounds spray-discharge orifices 7. Circular wall 37 is designed in such a way that it projects beyond each spray-discharge orifice 7 in the axial direction, in this way providing a shield for each spray-discharge orifice 7 from the mixture flows circulating in the combustion chamber.

In the exemplary embodiment at hand, spray-discharge orifices 7 are formed in a convexly rounded end face 36 of valve-seat member 5. However, end face 36 may also have a flat or even concave shape, as long as ring wall 37 axially projects beyond each spray-discharge orifice 7.

Spray-discharge orifices 7 may be introduced at any point within circular wall 37. Preferably, they are located on a plurality of round or elliptical hole circles, which may be in a concentric or eccentric arrangement with respect to one another, or could be arranged on a plurality of straight or curved tracks of punched holes that are arranged in parallel, diagonally or offset with respect to one another. The distance between the hole centers may be equidistant or may differ, but should amount to at least one hole diameter, for reasons of production engineering. The spatial orientation may vary for each hole axis, as sketched in FIG. 2 for two spray-discharge orifices 7.

Circular wall 37 may, for instance, already be produced in one piece together with valve-seat member 5, which is preferably formed by turning on a lathe or machine-cutting. A subsequent mounting of circular wall 37, for example, by welding or soldering, is also conceivable.

Shielding spray-discharge orifices 7 from mixture flows in the combustion chamber makes it possible to reduce the formation of deposits in spray-discharge orifices 7. Since, typically, the diameter of spray-discharge orifices 7 is approximately 100 μm, the danger of spray-discharge orifices 7 getting clogged over time by the formation of deposits, and the flow rate being unacceptably restricted as a result, is relatively high. Circular wall 37 is able to prevent a return flow of the fuel to spray-discharge orifices 7 and, thus, a fuel deposition and subsequent deposit formation when the combustion chamber fill is burned off. The axial height of circular wall 37 may be relatively low in this case, since the mixture flow, due to the conditions prevailing in the combustion chamber, strikes the tip of fuel injector 1 approximately perpendicularly to the orientation of spray-discharge orifices 7.

Figure 3:
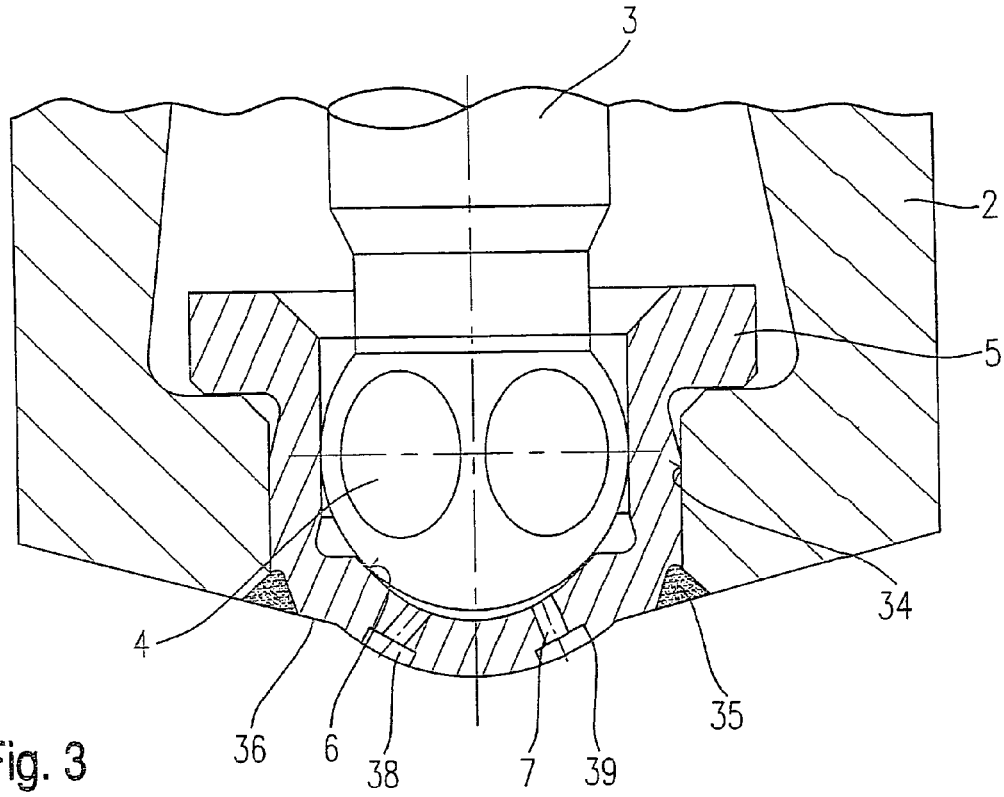
FIG. 3 shows a schematic section through a second exemplary embodiment of the fuel-injection system according to the present invention, in the same region as FIG. 2.

FIG. 3 shows a second exemplary embodiment of a fuel injector 1 designed according to the present invention, in the same view as FIG. 2. Identical components have been provided with corresponding reference numerals.

Instead of locating a circular wall at end face 36 of valve-seat member 5, the outlets of spray-discharge orifices 7 may also be shielded by placing the outlets at a greater depth. For this purpose, at least one annular groove 38 is introduced into end face 36 of valve-seat member 5, into which all spray-discharge orifices 7 discharge.

Spray-discharge orifices 7 are, therefore, recessed with respect to end face 36 of valve-seat member 5, so that here, too, no return flow of the fuel to the outlets of spray-discharge orifices 7 takes place, since an outer edge 39 of the at least one annular groove 38 shields the outlets of spray-discharge orifices 7.

As in the previous exemplary embodiment, spray-discharge orifices 7 may also be configured as desired, the sole requirement being, namely, that all spray-discharge orifices 7 discharge into the at least one annular groove. The annular grooves may be oval or round or designed in the form of graduated circles.

It is also possible to form a single annular groove 38 in such a way that the interior section of end face 36 of valve-seat member 5 is curved in a concave manner and, thus, outer edge 39 of annular groove 38 likewise projects above spray-discharge orifices 7 located in the inner region, and shielding them in their entirety from the combustion-chamber flows.

The present invention is not limited to the exemplary embodiments shown and may be used, for instance, for spray-discharge orifices 7 arranged in any desired pattern, for divided circle-shaped circular walls 37 and annular grooves 38 and for any design of multiple-hole fuel injectors 1 discharging to the inside.

What is claimed is:

1. A fuel injector for a fuel-injection system of an internal combustion engine, the engine having a combustion chamber, the fuel injector comprising:

a valve-seat member having a cup-shaped design;

a valve-seat surface situated at the valve-seat member;

a valve-closure member which, together with the valve-seat surface, forms a sealing seat;

an energizable actuator;

a valve needle in operative connection with the actuator;

a restoring spring acting upon the valve needle in a closing direction to actuate the valve-closure member; and at least two spray-discharge orifices situated in the valve-seat member, an axis of each orifice having a different spatial orientation within the valve-seat member, the valve-seat member having a convexly rounded end face forming an outermost tip of a discharge-side part of the fuel injector on which a shielding of the spray-discharge orifices formed on the convexly rounded end face as one single rounded ring wall surrounding all of the at least two spray-discharge orifices and projecting beyond the at least two spray-discharge orifices in an axial direction from the convexly rounded end face is provided to prevent a return flow of the fuel to the spray-discharge orifices.

2. The fuel injector according to claim 1, wherein the ring wall has an annular design.

* * * * *